US007229530B2

(12) United States Patent
Anderson et al.

(10) Patent No.: US 7,229,530 B2
(45) Date of Patent: Jun. 12, 2007

(54) METHOD FOR REDUCING UNDESIRABLE ODORS GENERATED BY PAPER HAND TOWELS

(75) Inventors: Ralph Anderson, Marietta, GA (US); Tameka Spence, Lawrenceville, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 672 days.

(21) Appl. No.: 10/039,236

(22) Filed: Dec. 31, 2001

(65) Prior Publication Data

US 2003/0145965 A1 Aug. 7, 2003

(51) Int. Cl.
*D21F 11/00* (2006.01)

(52) U.S. Cl. ..... 162/158; 162/184; 162/168.3; 162/112; 162/135; 162/186; 162/204

(58) Field of Classification Search ..... 162/158, 162/12, 184, 168.3, 112, 135, 183, 111, 204, 162/207, 186
See application file for complete search history.

(56) References Cited

U.S. PATENT DOCUMENTS

| | | | | |
|---|---|---|---|---|
| 3,303,576 | A | | 2/1967 | Sisson |
| 3,840,395 | A | | 10/1974 | Koch |
| 4,002,486 | A | | 1/1977 | Kotani et al. |
| 4,863,987 | A | | 9/1989 | Hoshino et al. |
| 4,994,146 | A | * | 2/1991 | Soerens ..... 162/112 |
| 5,048,589 | A | | 9/1991 | Cook et al. |
| 5,122,407 | A | | 6/1992 | Yeo et al. |
| 5,300,192 | A | | 4/1994 | Hansen et al. |
| 5,308,896 | A | | 5/1994 | Hansen et al. |
| 5,352,480 | A | | 10/1994 | Hansen et al. |
| 5,575,891 | A | | 11/1996 | Trokhan et al. |
| 5,624,532 | A | | 4/1997 | Trokhan et al. |
| 5,624,676 | A | | 4/1997 | Mackey et al. |
| 5,705,164 | A | | 1/1998 | Mackey et al. |
| 5,981,044 | A | | 11/1999 | Phan et al. |
| 5,998,032 | A | | 12/1999 | Hansen et al. |
| 6,033,523 | A | | 3/2000 | Dwiggins et al. |
| 6,068,731 | A | | 5/2000 | Dwiggins et al. |
| 6,120,644 | A | | 9/2000 | Schroeder et al. |
| 6,126,784 | A | | 10/2000 | Ficke et al. |
| 6,143,131 | A | | 11/2000 | Dwiggins et al. |
| 6,149,767 | A | | 11/2000 | Hermans et al. |
| 6,156,157 | A | | 12/2000 | Schroeder et al. |
| 6,162,329 | A | | 12/2000 | Vinson et al. |
| 6,187,141 | B1 | | 2/2001 | Takeuchi et al. |
| 6,190,735 | B1 | | 2/2001 | Radwanski et al. |
| 6,200,418 | B1 | | 3/2001 | Oriaran et al. |
| 6,207,012 | B1 | | 3/2001 | Oriaran et al. |
| 6,228,216 | B1 | | 5/2001 | Lindsay et al. |
| 6,241,850 | B1 | | 6/2001 | Kelly |
| 6,254,724 | B1 | | 7/2001 | Seltzer et al. |
| 6,395,395 | B1 | | 5/2002 | Hansen et al. |

FOREIGN PATENT DOCUMENTS

| | | |
|---|---|---|
| WO | WO 96/08601 A1 | 3/1996 |
| WO | WO 97/06306 | 2/1997 |
| WO | WO 97/06307 | 2/1997 |

OTHER PUBLICATIONS

Smook, Gary A., Handbook for Pulp and Paper Technologists, 1992, pp. 264-265.*

Cullis, C.F., et al., "Combustion of Cigarette Paper Under Conditions Similar to Those During Smoking", *Cellulose & Its Derivatives*, 1985, Chapter 35, Kennedy et al., eds., Ellis Horwood Ltd.

LeVan, S.L., "Chemistry of Fire Retardancy", *The Chemistry of Solid Wood*, 1984, Chapter 14, R. Rowell, editor, Advances in Chemistry Series 207 American Chemical Society.

Shafizadeh, F., "Thermal Degradation of Cellulose", *Cellulose Chemistry and its Applications*, 1985, Chapter 11, Nevell & Zeronian, eds., Ellis Horwood Ltd.

K.Wiik, et al., "Studies on Odour Reduction in TCF Bleached Packaging Paper", *Journal of Pulp and Paper Science*, Sep. 1998, vol. 24, No. 9.

International Search Report from PCT/US 2004/000861 dated Jun. 29, 2004.

International Search Report from PCT/US 02/39570 dated Sep. 29, 2003.

* cited by examiner

*Primary Examiner*—Mark Halpern
(74) *Attorney, Agent, or Firm*—Senniger Powers

(57) ABSTRACT

A process for manufacturing a cellulosic paper product is provided. The process comprises forming an aqueous suspension of papermaking fibers; depositing the aqueous suspension onto a sheet-forming fabric to form a wet web; dewatering the wet web to form a partially dewatered web; topically applying a glycol compound selected from the group consisting of polyethylene glycol, triethylene glycol, glycerol and mixtures thereof to the partially dewatered web; and drying said wet web. The present invention also provides for cellulosic paper products exhibiting a reduced malodor upon wetting.

24 Claims, No Drawings

METHOD FOR REDUCING UNDESIRABLE ODORS GENERATED BY PAPER HAND TOWELS

FIELD OF THE INVENTION

This invention relates to a method for reducing undesirable odors generated by paper hand towels upon wetting and, more particularly, to such a method which involves the topical application of a polyethylene glycol, triethylene glycol or glycerol compound to a partially dewatered tissue web formed from papermaking fibers.

BACKGROUND OF THE INVENTION

Commercial paper products such as hand towels are manufactured from cellulosic base sheets. A cellulosic base sheet is a paper product in its raw form prior to undergoing post-treatment such as calendaring and embossing. In general, cellulosic base sheets are made by preparing an aqueous suspension of papermaking fibers and depositing the suspension onto a sheet-forming fabric to form a wet web, which is then dewatered and dried to produce a base sheet suitable for finishing.

Wet web base sheets are commonly dried by through-air drying, which comprises removing water from a wet web by passing hot air through the web. More specifically, through-air drying typically comprises transferring a partially dewatered wet-laid web from a sheet-forming fabric to a coarse, highly permeable through-drying fabric. The wet web is then retained on the through-drying fabric while heated air is passed through the web until it is dry. One process for through-drying base sheets is the Un-Creped Through Air Dried (UCTAD) process, as described, for example, in U.S. Pat. No. 6,149,767, which is hereby incorporated by reference. In the UCTAD process, a wet base sheet is partially dewatered and through-air dried by passing hot air through the wet sheet as it runs over a through-drying fabric on a drum roll.

Based upon consumer complaints, it was observed that a strong, burnt popcorn odor was often emitted from hand towels when the towels were wetted. Upon investigation, this problem of malodor was found to be present in cellulosic base sheets which had been through-air dried at relatively high air temperatures including, for example, sheets dried by the UCTAD process. It was hypothesized that over-drying or over-heating of the base sheets was leading to the malodor problem upon re-wetting. Thus, by operating the through-air drying process at lower temperatures and slightly longer residence times, the malodor problem has largely been eliminated. However, lower operating temperatures and longer residence times adversely affect the overall productivity of the base sheet manufacturing process. Therefore, a need exists for a process which can eliminate malodor in through-dried cellulosic base sheets wherein higher drying temperatures and shorter residence times can be used to increase product throughput and productivity.

DESCRIPTION OF RELATED ART

The use of polyethylene glycol is known in the papermaking art. U.S. Pat. No. 6,162,329 discloses the use of polyethylene glycol of various molecular weights as a plasticizer in the manufacture of quaternary ammonium softening agents for tissue paper products, the composition being added to a dry tissue web or semi-dry tissue web. U.S. Pat. No. 5,624,532 discloses the use of polyhydroxy compounds such as polyoxyethylene to impart tactile softness to tissue papers by applying such compounds to a web formed by wet-laying an aqueous slurry containing cellulosic fibers. In U.S. Pat. No. 6,120,644 it is disclosed that polyethylene glycol can be added tot he surface of a tissue web individually or in combination with other solvents which should contain 1–100% of a softening agent. The use of polyethylene glycol as a plasticizer in quaternary amine softening agents is disclosed in U.S. Pat. Nos. 6,126,784 and 6,241,850. The use of polyethylene glycol as a humectant in combination with softening agents in the manufacture of tissue products is disclosed in U.S. Pat. Nos. 6,200,418 and 6,207,012.

There remains a need for an effective method for reducing undesirable odors generated by paper hand towels upon wetting.

SUMMARY OF THE INVENTION

Among the several objects of the present invention, therefore, is the provision of a process for making a cellulosic paper product from a wet-laid web; the provision of such a process wherein the paper products exhibit a reduced malodor upon re-wetting; the provision of such a process wherein the wet-laid web can be through-air dried at higher temperatures and shorter residence times; the provision of such a process wherein productivity and throughput are increased; and the provision of such a process which is relatively inexpensive and easy to implement.

Briefly, therefore, the present invention is directed to a process for manufacturing a cellulosic paper product. The process comprises forming an aqueous suspension of papermaking fibers. The aqueous suspension of papermaking fibers is deposited onto a sheet-forming fabric to form a wet web which is then dewatered to form a partially dewatered web. A glycol compound selected from the group consisting of polyethylene glycol, triethylene glycol, glycerol and mixtures thereof is topically applied to the partially dewatered web which has a fiber consistency of about 80% or less. The partially dewatered web is subsequently dried by passing heated air through the web at a temperature of at least about 175° C.

In a further embodiment, the process of the present invention comprises forming an aqueous suspension of papermaking fibers. The aqueous suspension of papermaking fibers is deposited onto a sheet-forming fabric to form a wet web which is then dewatered to produce a partially dewatered web having a fiber consistency of about 80% or less. A glycol compound selected from the group consisting of polyethylene glycol, triethylene glycol, glycerol and mixtures thereof is topically applied to the partially dewatered web in an add-on amount ranging from about 0.5% to about 20% by weight of said papermaking fibers in the web. The partially dewatered web is subsequently dried.

The present invention is further directed to cellulosic paper products produced by the processes disclosed herein and characterized as having a reduced malodor upon wetting.

Other objects and features of the present invention will be in part apparent and in part pointed out hereinafter.

DESCRIPTION OF THE PREFERRED EMBODIMENTS

In accordance with the present invention, it has been discovered that a cellulosic base sheet having a reduced malodor upon re-wetting can be produced by topically applying a glycol compound selected from the group consisting of polyethylene glycol, triethylene glycol, glycerol and mixtures thereof to a partially dewatered web of papermaking fibers from which the base sheet is formed. The partially dewatered webs to which the glycol compound is applied can be dried at higher temperatures and shortened residence times while significantly reducing malodor produced upon re-wetting of the base sheets. Cellulosic paper products made from base sheets which have been so processed have been shown to have a less objectionable odor upon re-wetting than products made from base sheets not so treated.

As part of the present invention, possible reaction mechanisms in the base sheet production process which may be contributing to the presence of odorous compounds in cellulosic base sheets have been investigated. Without being held to a particular theory, it is believed that malodor in base sheets dried at high temperatures is caused by acid-catalyzed reactions which form volatile organic compounds or odor precursors during drying. It is believed that these odorous compounds are formed within a cellulosic base sheet during drying and bound within the sheet until the moment that the sheet is re-wetted. The combination of acid in the sheet and the addition of water upon re-wetting cleaves the odorous compounds from the sheet and releases the compounds into the environment. In particular, experience to date suggests that a large number of the odor-causing compounds released from re-wetted base sheets can be characterized as medium chain aliphatic aldehydes (e.g., octanal, nonanal, decanal) and/or furans (e.g., furfural, furfuryl alcohol, hydroxymethyl furfural). Thus, it is believed that the presence of volatile aldehyde compounds and/or furan compounds, either alone or in combination, may be responsible for the base sheet malodor. These odor-causing compounds may be produced during high temperature drying of the wet web by any conventional means including Yankee dryers and through-air dryers, but are particularly problematic in through-dried base sheets, perhaps due to the highly oxidative environment and unique mass transfer phenomena provided by the air stream passing through the web.

Aldehyde Hypothesis

Experience to date with analyzing re-wetted base sheets, as described, for example, in Example 1 below, indicates that a substantial component of the malodor released from through-dried cellulosic base sheets upon re-wetting comprises medium-chain, aliphatic aldehydes having from about 6 to about 10 carbon atoms. Without being bound by a particular theory, it is believed that the aldehydes are formed within the base sheet by the oxidation of fatty acids present in the aqueous suspension of papermaking fibers. For example, during chlorine dioxide bleaching, which is conducted under acidic conditions at a pH of about 3.5, fatty acids present in the aqueous suspension of papermaking fibers are either bound by ester linkages to carbohydrates or oxidized to smaller aliphatic aldehydes. Alternatively, aldehydes may be formed in the base sheet during drying, wherein bound fatty acids within the wet web can be oxidized to aliphatic aldehydes by heating.

As water is driven from the wet web during drying, a portion of the aliphatic aldehydes present in the wet web may react with vicinal diols present in the carbohydrates to form acetal linkages, thus binding the aldehydes to the sheet fibers. This acetal formation between the aliphatic aldehydes and vicinal diols in a wet web base sheet is a reversible reaction, with equilibrium between the free aldehyde and bound acetal depending upon the amount of water present. For example, as water is being driven off, the reaction favors acetal formation. When water is added, and especially in the presence of acid, the acetal will break down to an aldehyde. Therefore, it is believed that when water is added to the dried sheet (i.e., the sheet is re-wetted), an acid-catalyzed reversal of the acetal formation reaction liberates the free aldehyde, thus releasing the aldehyde from the base sheet and into the environment.

Furan-Compound Hypothesis

Analyses of organic extracts from re-wetted base sheets have also indicated the presence of furan components, in particular, furfural, furfuryl alcohol and hydroxymethyl furfural. These furans possess a burnt odor substantially similar to the odor displayed by the re-wetted base sheets. Without being bound by a particular theory, it is believed that acid-catalyzed degradation of carbohydrates present in the base sheet occurs during through-air drying, to generate a furan precursor attached to the carbohydrates. The furan precursor is then liberated and released by another acid-catalyzed reaction when water is added (i.e. the sheet is re-wetted). While the liberation step could theoretically occur during further air-drying, it is believed that a rapid loss of water essentially leaves little or no solvent for subsequent reaction.

Glycol Compound Effect

In accordance with the present invention, it has been found that topically applying a glycol compound selected from the group consisting of polyethylene glycol, triethylene glycol, glycerol and mixtures thereof to a partially dewatered web of cellulosic papermaking fibers can adequately suppress the formation of aldehydes and/or furans as described above to substantially reduce malodor released upon re-wetting of the cellulosic base sheets produced from such partially dewatered webs. For example, without being held to a particular theory, it has been found that topically applying a glycol compound such as polyethylene glycol, triethylene glycol, glycerol and mixtures thereof to a wet-laid web of papermaking fibers advantageously results in the formation of an ester complex with carboxylic acid groups and hemicellulose present within the web of papermaking fibers. This ester complex formation is believed to substantially neutralize or eliminate free carboxylic acid groups in the tissue web that would normally be available to partake in the generation of odorous compounds during drying as previously described.

Therefore, in one embodiment, the process of the present invention generally comprises preparing an aqueous suspension of cellulosic papermaking fibers. Suitable cellulosic fibers for use in the present invention include virgin papermaking fibers and secondary (i.e., recycled) papermaking fibers in all proportions. Such fibers include, without limitation, hardwood and softwood fibers along with nonwoody fibers. Non-cellulosic synthetic fibers can also be included as a component of the aqueous suspension. It has been found that a high quality product having a unique balance of properties can be made using predominantly, and more preferably substantially all (i.e., up to 100%) secondary or recycled cellulosic fibers. The aqueous suspension of papermaking fibers may include various additives conventionally employed by those skilled in the art, including, without limitation, wet strength resins (e.g., KYMENE, Hercules, Inc.), fillers and softeners/debonders.

After the suspension of papermaking fibers is formed, the suspension is deposited onto a web forming apparatus (i.e., a sheet-forming fabric) to form a wet web. The web forming apparatus can be any conventional sheet-forming apparatus known in the art of papermaking. For example, such formation apparatus include Fourdrinier, roof formers (e.g., suction breast roll), gap formers (e.g., twin wire formers, crescent formers), or the like.

After the wet web has been formed, the web is preferably partially dewatered to form a partially dewatered web. For example, after deposition of the aqueous suspension onto a sheet-forming fabric, the wet web is partially dewatered to form a partially dewatered web having a consistency of from about 20% to about 80% (e.g., having a consistency of about 20%, 25%, 30%, 35%, 40%, 50%, 60%, 70% or 80%). Partial dewatering may be achieved by any means generally known in the art, including vacuum dewatering (e.g., vacuum boxes) and/or mechanical pressing operations.

The process of the invention further comprises topically applying a glycol compound selected from the group consisting of polyethylene glycol, triethylene glycol, glycerol and mixtures thereof to the partially dewatered web. Generally, the glycol compound may be topically applied to the partially dewatered web by any means known within in the art. For example, suitable methods for topical application of a glycol compound to a partially dewatered web include but are not limited to spraying, rotogravure printing, trailing blade coating and the like. In accordance with a preferred embodiment, the glycol compound to be topically applied to the partially dewatered web comprises polyethylene glycol having a molecular weight of from about 400 to about 800. Even more preferably, the glycol compound to be topically applied comprises polyethylene glycol having a molecular weight of about 600.

When the glycol compound to be applied to the partially dewatered web comprises polyethylene glycol, the polyethylene glycol is preferably applied to the partially dewatered web in an add-on amount of from about 0.5 to about 20% by weight of the papermaking fibers in the web. More preferably, the polyethylene glycol is applied to the partially dewatered web in an add-on amount of from about 1 to about 2% by weight of the papermaking fibers in the web. When the glycol compound to be topically applied to the partially dewatered web comprises triethylene glycol or glycerol, the glycol compound should be applied in an add-on amount of from about 1 to about 5% by weight of the papermaking fibers in the web. Smaller amounts may also be effective for effecting some reduction in the intensity of malodor emanating from hand towels upon re-wetting. However, it is important to apply the glycol compound to the partially dewatered web in an amount sufficient to ensure uniform dispersion of the glycol compound across the papermaking fibers of the web.

It is further contemplated that the glycol compound may be introduced to the papermaking fibers by means other than topical application (e.g., by introducing the glycol compound to the aqueous suspension of papermaking fibers during pulping). However, experience to date suggests that the glycol compounds used in the process of the invention are not adequately retained by the papermaking fibers when added to an aqueous suspension of the papermaking fibers. Without being held to a particular theory, it is believed that the hydrophilic nature of the glycol compounds used in the present invention results in poor retention of the glycol compound on the papermaking fibers in the presence of a significant amount of water (i.e., if the consistency of the papermaking fibers is less than about 10%).

In accordance with a preferred embodiment, the glycol compound is topically applied to the partially dewatered web as an aqueous solution comprising from about 1 to about 80% of the glycol compound. For example, when polyethylene glycol 600 is the glycol compound to be topically applied, polyethylene glycol 600 is preferably applied as an aqueous solution having a concentration of approximately 1 to 80% polyethylene glycol in water.

After topical application of the glycol compound, the partially dewatered web is dried. The partially dewatered web may be dried by any means generally known in the art for making cellulosic base sheets, including Yankee dryers and through-air dryers. Preferably, the web is through-dried by passing a heated gas through the web at a temperature of at least about 175° C. (347° F.), more preferably at least about 190° C. (375° F.). Even more preferably, the partially dewatered web is through-dried by passing heated air through the wet web at an air temperature of from about 190° C. (375° F.) to about 210° C. (410° F.), and especially at an air temperature of from about 200° C. (395° F.) to about 205° C. (400° F.).

Individual cellulosic paper products made from the base sheets prepared in accordance with the present invention may, include, for example, tissues, absorbent towels, napkins, and wipes of one or more plies and varying finish basis weights. For multi-ply products, it is not necessary that all plies of the product be the same, provided that at least one ply is made in accordance with the present invention. Suitable basis weights for these products can be from about 5 to about 70 grams/$m^2$. In accordance with a preferred embodiment, the cellulosic paper products have a finish basis weight ranging from about 25 to about 45 grams/$m^2$, even more preferably from about 30 to about 40 grams/$m^2$.

The process of the present invention has not been found to significantly alter the physical properties of the cellulosic base sheet products produced by the process in any capacity other the substantial reduction in the release of malodor upon re-wetting. For example, through-dried cellulosic base sheets produced by the process of the invention generally contain an amount of stretch of from about 5 to about 40 percent, preferably from about 15 to about 30 percent. Further, products of this invention can have a machine direction tensile strength of about 1000 grams or greater, preferably about 2000 grams or greater, depending on the product form, and a machine direction stretch of about 10 percent or greater, preferably from about 15 to about 25 percent. More specifically, the preferred machine direction tensile strength for products of the invention may be about 1500 grams or greater, preferably about 2500 grams or greater. Tensile strength and stretch are measured according to ASTM D1117-6 and D1682. As used herein, tensile strengths are reported in grams of force per 3 inches (7.62 centimeters) of sample width, but are expressed simply in terms of grams for convenience.

The aqueous absorbent capacity of the products of this invention is at least about 500 weight percent, more preferably about 800 weight percent or greater, and still more preferably about 1000 percent or greater. It refers to the capacity of a product to absorb water over a period of time and is related to the total amount of water held by the product at is point of saturation. The specific procedure used to measure the aqueous absorbent capacity is described in Federal Specification No. UU-T-595C and is expressed, in percent, as the weight of water absorbed divided by the weight of the sample product.

The products of this invention can also have an aqueous absorbent rate of about 1 second or less. Aqueous absorbent rate is the time it takes for a drop of water to penetrate the surface of a base sheet in accordance with Federal Specification UU-P-31b.

Still further, the oil absorbent capacity of the products of this invention can be about 300 weight percent or greater, preferably about 400 weight percent or greater, and suitably from about 400 to about 550 weight percent.

The procedure used to measure oil absorbent capacity is measured in accordance with Federal Specification UUT 595B. The products of this invention exhibit an oil absorbent rate of about 20 seconds or less, preferably about 10 seconds or less, and more preferably about 5 seconds or less. Oil absorbent rate is measured in accordance with Federal Specification UU-P-31b.

EXAMPLES

The following examples set forth one approach that may be used to carry out the process of the present invention. Accordingly, these examples should not be interpreted in a limiting sense.

Example 1

Sample hand sheets or towels were prepared as follows:

An aqueous suspension of papermaking fibers was formed by depositing the aqueous suspension of papermaking fibers onto a forming fabric. The tissue web was then 30–40% dewatered. Each of the sample hand sheets was sprayed with the following materials and the samples were then dried at 350–400° F. After wetting, the hand sheets were each tested for odor intensity with the following results:

| Sample No. | Material Sprayed onto Samples | Odor Description (0–5) |
|---|---|---|
| 1 | Untreated | 2 |
| 2 | 3% Polyethylene glycol 600 | 0–1 |
| 3 | 5% Polyethylene glycol 600 | 0 |
| 4 | 10% Polyethylene glycol 600 | 0 |
| 5 | 20% Polyethylene glycol 600 | 0 |
| 6 | 5% Glycerol | 0 |

Example 2

Sample hand sheets or towels were prepared as described in Example 1. 3% and 5% polyethylene glycol 600 in water solutions were sprayed onto the samples which were then dried. Upon being rewetted, the samples were tested for odor intensity with the following results:

| Sample | Material Sprayed onto Samples | Wt. | Wt. After Spraying | Wt. After Drying | Odor |
|---|---|---|---|---|---|
| 1 | 3% PEG 600 | 5.11 g | 6.12 g | 1.51 g | N |
| 2 | 3% PEG 600 | 4.04 g | 5.48 g | 1.38 g | N |
| 3 | 5% PEG 600 | 3.28 g | 4.44 g | 1.32 g | N |
| 4 | 5% PEG 600 | 3.65 g | 4.94 g | 1.45 g | N |

Thus, none of the treated samples was determined to emit any detectable odor.

Example 3

Sample hand towels were prepared as described in Example 1. Each sample was sprayed with polyethylene glycol 600 in water solutions and then air dried. Upon re-wetting, the samples were tested for odor intensity with the following results:

A) 1.5% polyethylene glycol 600 water in water

| Initial Towel Wt. | Final Towel Wt. | Odor | % PEG Added |
|---|---|---|---|
| 2.137 g | 2.930 g | N | 37% |
| 2.037 g | 3.066 g | N | 46.7% |
| 2.061 g | 2.750 g | N | 33.4% |

B) 2% polyethylene glycol 600 water in water

| Initial Towel Wt. | Final Towel Wt. | Odor | % PEG Added |
|---|---|---|---|
| 2.122 g | 3.488 g | N | 64.37% |
| 2.060 g | 2.944 g | N | 43% |
| 2.026 g | 2.887 g | N | 42.4% |

C) 3% polyethylene glycol 600 water in water

| Initial Towel Wt. | Final Towel Wt. | Odor | % PEG Added |
|---|---|---|---|
| 2.092 g | 3.722 g | N | 77.9% |
| 2.061 g | 2.9039 | N | 40.8% |
| 2.109 g | 2.808 g | N | 33.14% |

Example 4

Handsheets or hand towels were prepared on a continuous handsheet former (CHF) by first forming an aqueous suspension of papermaking fibers, forming a tissue web by depositing the fibers onto a forming wire, rendering the web 30% dewatered and then topically applying to the web the materials indicated in the following table. A total of 16 panelists evaluated the products by ranking them from least to most for the intensity of overall objectionable odor. The rank sums were analyzed with Friedman and Tukey statistics to compare the products with one another.

The table below summarizes the primary analysis. The untreated base sheet had the strongest level of objectionable odor among the products while the prototype with 20% polyethylene glycol 600 had the lowest level.

| Products Ranked for Objectionable Odor | | | | | |
|---|---|---|---|---|---|
| Untreated | 3% PEG 600 | 5% PEG 600 | 10% PEG 600 | 20% PEG 600 | 5% Glycerol |
| 73a | 59ab | 49ab | 50ab | 32b | 54ab |

The higher the rank sum, the higher the level of objectionable odor.

In view of the above, it will be seen that the several objects of the invention are achieved and other advantageous results attained. As various changes could be made in the above process or method and product without departing from the scope of the invention, it is intended that all matter contained in the above description and examples shall be interpreted as illustrative and not in a limiting sense.

What is claimed is:

1. A process for manufacturing a cellulosic paper product, the process comprising:

forming an aqueous suspension of papermaking fibers;

depositing said aqueous suspension of papermaking fibers onto a sheet-forming fabric to form a wet web;

dewatering said wet web to form a partially dewatered web;

topically applying a glycol compound selected from the group consisting of polyethylene glycol, triethylene glycol, glycerol and mixtures thereof to said partially dewatered web, said partially dewatered web having a fiber consistency of about 80% or less; and drying said partially dewatered web by passing heated air at a temperature of at least about 175° C. through said web.

2. A process as set forth in claim 1 wherein said glycol compound is polyethylene glycol having a molecular weight of from about 400 to about 800.

3. A process as set forth in claim 2 wherein said glycol compound comprises polyethylene glycol having a molecular weight of approximately 600.

4. A process as set forth in claim 3 wherein said glycol compound is topically applied to said partially dewatered web in an add-on amount of about 0.5 to about 20% by weight of said papermaking fibers in said partially dewatered web.

5. A process as set forth in claim 4 wherein said glycol compound is topically applied to said partially dewatered web in an add-on amount of about 1 to about 2% by weight of said papermaking fibers in said partially dewatered web.

6. A process as set forth in claim 4 wherein the temperature of said heated air is from about 190° to about 210° C.

7. A process as set forth in claim 6 wherein the temperature of said heated air is from about 200° to about 205° C.

8. A process as set forth in claim 3 wherein said glycol compound is topically applied to said partially dewatered web as an aqueous solution comprising from about 1 to about 80% polyethylene glycol.

9. A process as set forth in claim 8 wherein said aqueous solution of said glycol compound comprises from about 40 to about 60% polyethylene glycol.

10. A process as set forth in claim 1 wherein said glycol compound comprises triethylene glycol.

11. A process as set forth in claim 1 wherein said glycol compound comprises glycerol.

12. A process as set forth in claim 1 wherein said glycol compound is topically applied to said partially dewatered web by spraying.

13. A process for manufacturing a cellulosic paper product, the process comprising:

forming an aqueous suspension of papermaking fibers;

depositing said aqueous suspension of papermaking fibers onto a sheet-forming fabric to form a wet web;

dewatering said wet web to produce a partially dewatered web having a fiber consistency of about 80% or less;

topically applying a glycol compound selected trots the group consisting of polyethylene glycol, triethylene glycol, glycerol and mixtures thereof to said partially dewatered web in an add-on amount of from about 0.5% to about 20% by weight of said papermaking fibers in said web; and drying said partially dewatered web.

14. A process as set forth in claim 13 wherein said glycol compound is polyethylene glycol having a molecular weight of from about 400 to about 800.

15. A process as set forth in claim 14 wherein said glycol compound comprises polyethylene glycol having a molecular weight of approximately 600.

16. A process as set forth in claim 15 wherein said glycol compound is topically applied to said partially dewatered web in an add-on amount of about 1 to about 2% by weight of said papermaking fibers in said partially dewatered web.

17. A process as set forth in claim 15 wherein said partially dewatered web is dried by passing heated air at a temperature of at least about 190° C. through said web.

18. A process as set forth in claim 17 wherein the temperature of said heated air is from about 190° to about 210° C.

19. A process as set forth in claim 18 wherein the temperature of said heated air is from about 200° to about 205° C.

20. A process as set forth in claim 15 wherein said glycol compound is topically applied to said partially dewatered web as an aqueous solution comprising from about 1 to about 80% polyethylene glycol.

21. A process as set forth in claim 15 wherein said aqueous solution of said glycol compound comprises from about 40 to about 60% polyethylene glycol.

22. A process as set forth in claim 13 wherein said glycol compound comprises triethylene glycol.

23. A process as set forth in claim 13 wherein said glycol compound comprises glycerol.

24. A process as set forth in claim 13 wherein said glycol compound is topically applied to said partially dewatered web by spraying.

* * * * *